United States Patent [19]

Acquaviva

[11] Patent Number: 4,834,360

[45] Date of Patent: May 30, 1989

[54] JOB BATCHING SYSTEM FOR HIGH CAPACITY COPIER WITH RDH

[75] Inventor: Thomas Acquaviva, Penfield, N.Y.

[73] Assignee: Xerox Corporation, Stamford, Conn.

[21] Appl. No.: 134,341

[22] Filed: Dec. 17, 1987

[51] Int. Cl.[4] ..... B65H 39/10

[52] U.S. Cl. ..... 271/3.1; 271/288; 271/301

[58] Field of Search ..... 271/3.1, 301, 288

[56] References Cited

U.S. PATENT DOCUMENTS

| | | | |
|---|---|---|---|
| 3,687,540 | 8/1972 | Hashimoto | 355/14 |
| 4,093,372 | 6/1978 | Guenther | 355/50 |
| 4,126,390 | 11/1978 | Connin | 355/14 |
| 4,156,133 | 5/1979 | Legg | 235/92 SB |
| 4,192,607 | 3/1980 | Hage | 355/50 |
| 4,201,464 | 5/1980 | Botte et al. | 355/14 R |
| 4,211,483 | 7/1980 | Hannigan et al. | 355/14 R |
| 4,212,457 | 7/1980 | Guenther | 271/288 |
| 4,248,525 | 2/1981 | Sterrett | 355/14 SH |
| 4,248,528 | 2/1981 | Sahay | 355/14 SH |
| 4,285,591 | 8/1981 | Botte et al. | 355/14 C |
| 4,310,235 | 1/1982 | Lorenzo et al. | 355/6 |
| 4,350,329 | 9/1982 | Holzhauser et al. | 271/9 |
| 4,391,504 | 7/1983 | Acquaviva | 355/3 SH |
| 4,568,172 | 2/1986 | Acquaviva | 355/14 SH |
| 4,579,325 | 4/1986 | Pinckney | 271/301 X |
| 4,579,444 | 4/1986 | Pinckney et al. | 355/14 SH |
| 4,609,283 | 9/1986 | Murata et al. | 355/14 R |
| 4,639,125 | 1/1987 | Okuda et al. | 355/23 |
| 4,640,607 | 2/1987 | Bray | 355/14 R |
| 4,688,924 | 8/1987 | Anzai et al. | 355/3 SH |
| 4,693,590 | 9/1987 | Umeda | 355/14 SH |
| 4,731,637 | 3/1988 | Acquaviva | 271/3.1 X |
| 4,763,161 | 8/1988 | Forest | 355/14 SH |

FOREIGN PATENT DOCUMENTS 3630384 3/1987 Fed. Rep. of Germany .

OTHER PUBLICATIONS

Xerox Disclosure Journal, "Special Copier Job Programming Using SADH Input of RDH/SADH", R. J. Michatek, vol. 11, No. 1, Jan./Feb., 1986, pp. 41–42.

Xerox Disclosure Journal, "Programmable Automatic Document Feeder", T. Acquaviva, vol. 7, No. 1, Jan./Feb., 1982, p. 7.

Xerox Disclosure Journal, "Job Batching Document Handler", T. Acquaviva, vol. 7, No. 6, Nov./Dec., 1982, pp. 359–360.

Xerox Disclosure Journal, "Automated Document Queueing", D. J. Stemmle, vol. 6, No. 4, Jul./Aug., 1981, pp. 169–170.

Research Disclosure, "Coding Documents with Adjustable Copier Parameters", No. 18348, Jul. 1979.

Research Disclosure, "Document Feeder Registration Rest Caliabration", No. 25008, Feb. 1985.

*Primary Examiner*—Richard A. Schacher

[57] ABSTRACT

An automatic document job batching system for a copier with a recirculating document handler (RDH), with a document stacking tray into which a set of document sheets is loaded for recirculative precollation copying, and a separate (SADH) document loading entrance provided for semiautomatic non-precollation copying, utilizing a document gate for selectably directing documents to this tray or to be ejected from the RDH. All document jobs to be copied may be preloaded, and left unattended, for automatic sequential loading and copying, in a common stack, face down, as a batched plurality of intermixed documents and document set jobs interleaved with job slip sheets, in a job loading input adjacent the RDH which sequentially top feeds the documents into the SADH document entrance. Documents selected by slip sheet indica or otherwise to be precollation copied are automatically loaded into the RDH stacking tray one job batch at a time, or up to a preset document tray capacity, and then automatically recirculatively copied, and then automatically unloaded and ejected. RDH jobs with a number of documents exceeding the tray capacity are automatically divided, separately loaded, and separately recirculated, in sub-job sets of documents. Documents to be copied in a non-precollation copying mode are not loaded in the RDH tray and not recirculated, and automatically ejected. This reloading, selective copying, and ejecting is repeated in job batches until all preloaded documents have been copied.

13 Claims, 4 Drawing Sheets

JOB BATCHING SYSTEM FOR HIGH CAPACITY COPIER WITH RDH

Hereby cross-referenced, and incorporated by reference, are copending applications of the same assignee; U.S. Ser. No. 029,027 filed Mar. 23, 1987, by the same Thomas Acquaviva (sole) entitled "Automatic Dual Mode Sheet and Web Document Transport For Copiers" allowed; U.S. Ser. No. 098,096 filed Sept. 17, 1987 by James E. Britt, et al, entitled "Improved Copying System for On-Line Finishing", now U.S. Pat. No. 4,782,363 issued Nov. 1, 1988; and U.S. Ser. No. 117,762, allowed filed Nov. 6, 1987 by the same Thomas Acquaviva (et al) entitled "Document Handler Jam Clearance & Job Recovery System".

The present invention relates to copier document handling, and, more particularly, to an automatic job batching system for a copier with a recirculating document set handling system for precollation copying, for providing plural multiple precollated sets of copies of different copying jobs from plural sets of preloaded document sets in different copying recirulations. Automatic and appropriately oriented and controlled sequential loading of sequential jobs or sub-jobs in the circulating document handling system is provided.

Even with automatic document handlers, commercial copier operation normally requires an operator to be present at the completion of one job in order to load the next job, especially if both jobs are to be run in a precollation or recirculating document handler (RDH) mode. A document copying "job" normally involves the plural copying of a set of related documents in collated order to make a desired number of collated copy sets, and should not be confused with the ability of some copier document handlers to accept and feed an intermixed set of different individual original sheets. For a high speed copier or printer, especially for a centralized use product, it is very desirable to enable a dedicated operator to pre-load and pre-program a second, and further, jobs before or while a first job is run. This feature may be called "job batching" and/or "preprogramming." The system disclosed herein enables job batching and preprogramming for unattended copier operation in automatic copying modes for varying jobs.

A feature of the specific embodiment disclosed herein is to provide an improved system for automatically sequentially job-loading the RDH tray with one suitable document set for precollation copying at a time. This may be a separate job or sub-job. The documents are loaded from a separate document feeder feeding them into the separate non precollation or semi automatic document handling (SADH) input of a combined RDH/SADH document handler, rather than being conventionally loaded into the RDH tray from which they are recirculated. However, for RDH jobs the documents being loaded are diverted from the normal (straight across the platen and out) SADH path into the RDH return path, so that they stack into the RDH input tray on top of the RDH, and may then be run as precollation copying jobs.

Although there have been some suggestions in non-conventional or non-commercial patent literature noted herein relating to job batching and or preprogramming, it has remained commercially conventional to separately manually load each set of documents into the RDH tray for each job, and then remove same after copying, undesirably necessitating the presence of the copier operator at the beginning of each job. Furthermore, a suitable automatic job batching system should be simple and compact and yet be able to accommodate and automatically handle the preloading of a substantial number of widely varying jobs which can be run in RDH modes even is some jobs are too large for all the documents in that set to be loaded all at once into the RDH document recirculation and restacking tray. The present system provides a fully automatic system for handling a large number of separately programmed document set jobs irrespective of the number of documents in the document sets, even if this number exceeds the RDH recirculation or tray capacity.

The disclosed system can automatically load, but separate, overcapacity precollation copying jobs into separately recirculated job subsets, without requiring separate operator instructions or slip sheets to do so.

There is also disclosed herein a document loading and copying system with an automatic document sets stacking input tray and sequential document feeder at one side of a platen and a document sets stacking collection tray at the other side of a platen, providing multiple job batching into an RDH over the platen by means of interleaved coded program sheets leading each document job fed from the input tray and providing a wide variety of selectably variable copying job features.

The subject matter disclosed herein relates to both job batching and special programming. Job batching is a term utilized in connection with plural document set copying on copiers with automatic document sheet feeders, particularly recirculating document handlers. It desirably enables a copier operator to leave a large stack of documents (originals), which may include several different sets of documents, unattended at an input station for the document feeder, which may need to be differently copied. If automatic job batching can be provided, the copier will automatically copy the requisite number of copies of all of these preloaded documents and/or document sets without further operator attendance or input. With the addition of pre-programming or special programming, different, preselected, copying treatment or criteria may be provided for different jobs or documents.

The specific job batching system disclosed here utilizes the commercially desirable dual mode type of RDH which has both an RDH stacking input and a separate SADH document input. A job feeder feeds documents from the multi-document input or loading stack thereof into this SADH input, which then, instead of normally feeding the documents through to the SADH output, is specially programmed to feed these particular inputted documents up into the restack path of the RDH to stack these documents in the RDH tray, and then to recirculate them a preselected number of times, which may be a variable, and then to automatically unload them. However, normal SADH modes of operation may also be provided. Thus, a dual mode or dual function SADH input operation is provided.

In this disclosed system the number of these documents which are automatically loaded into the RDH tray at one time in this manner is automatically limited. It may be limited by slip sheet controls or the like separating the respective job sets, but it is also automatically limited to not exceed the RDH capacity, i.e., the RDH tray loading cycles are limited by a programmed document sheet count limit set to a maximum number of document sheets which the system allows to be loaded into the RDH tray from the job input tray in this manner for recirculation. That is, the job to be recirculated in the RDH at one time is either a separate job, automatically so indicated by a sensed slip sheet, or otherwise, or part of a larger job automatically broken up into smaller subsets thereof of a number of sheets which may be appropriately recirculated at one time in the RDH. Both types of jobs may be automatically ejected out of the SADH output of the document handler after the desired number of precollated copies have been made therefrom. The programming slip sheets may be premarked or other types of job separation systems may be utilized.

The present invention is fully compatible with modern improved precollation copying systems for recirculating documents for producing precollated copy sets at the full copying rate of a high speed copier. As noted, of particular interest are modern dual mode recirculating document handlers with a separate or SADH document input, i.e., RDH/SADH document handlers. In addition to the above cross-referenced applications, examples are disclosed in Xerox Corporation U.S. Pat. No. 4,579,444 issued Apr. 1, 1986 to T. S. Pinckney and H. J. Sanchez; or Eastman Kodak U.S. Pat. No. 4,192,607 issued Mar. 11, 1980 to C. T. Hage, and U.S. Pat. Nos. 4,350,329 issued Sept. 21, 1982 to R. C. Holzhauser et al, and 4,176,945 issued Dec. 4, 1979 to R. Holzhauser.

As xerographic and other copiers increase in speed, and become more automatic, it is increasingly important to provide higher speed yet more reliable and more automatic handling of the document sheets being copied, i.e. the input to the copier. It is desirable to feed, accurately register, and copy document sheets of a variety or mixture of sizes, types, weights, materials, conditions and susceptibility to damage, yet with minimal document jamming, wear or damage by the document transporting and registration apparatus, even if the same documents are automatically fed and registered repeatedly, as for recirculating document precollation copying.

The art of original document sheet handling for copiers has been intensively pursued in recent years. Various systems have been provided for automatic or semi-automatic feeding of document sheets to and over the imaging station of the copier for copying. The documents are normally fed over the surface of an imaging station comprising a transparent platen, into a registered copying position on the platen, and then off the platen. Such automatic or semi-automatic document handlers eliminate the need for the operator to place and align each document on the platen by hand. This is a highly desirable feature for copiers. Document handlers can automatically feed documents as fast as they can be copied, which cannot be done manually with higher speed copiers, thus enabling the full utilization or productivity of higher speed copiers.

A preferable document handling system is one that utilizes an existing or generally conventional copier optical imaging system, including the external transparent copying window (known as the platen or imaging station) of the copier. It is also desirable that the document handling system be readily removable, as by pivoting away, to alternatively allow the copier operator to conventionally manually place documents, including books, on the same copying platen. Thus, a lighter weight document handler is desirable. It is also desirable that a document registration edge alignment or positioning system be available for such manual copying which is compatible with that used for the document handler.

In preferred types of copying systems the document is registered for copying overlying a selected portion of full sized (full name) platen which is at least as large as the largest document to be normally copied automatically. In such systems the document is preferably either scanned or flashed while it is held stationary on the platen in the desired registration position. That is, in these full frame systems the document is preferably registered by being stopped and held during imaging at a preset position over the platen glass which is adjacent one side or edge thereof.

As shown in the art, and further discussed below, document handling systems have been provided with various document transports to move the documents over the copier platen and into registration. Such document platen transports may comprise single or plural transport belts or feed wheels, utilizing frictional, vacuum, or electrostatic sheet driving forces. Various combinations of such transports are known with various registration devices or systems. Preferably the same platen transport sheet feeder is used to drive a document onto and off of the platen before and after copying as well as registering the document.

In the description herein the term "document" or "sheet" refers to a usually flimsy sheet of paper, plastic, or other such conventional individual image substrate, and not to microfilm or electronic images which are generally much easier and faster to manipulate and reorder. It is important to distinguish electronic copying systems, such as the Xerox "9700" printer, which can read and store images of documents electronically and create copies by writing on a photoreceptor with a laser beam, or the like, since they do not have the problems dealt with here, with copying sets of physical document sheets.

The "document" here is the sheet (original or previous copy) being copied in the copier onto the outputted "copy sheet", or "copy". Related plural sheets of documents or copies are referred to as a "set" "or job". A "simplex" document or copy sheet is one having an image and "page" on only one side or face of the sheet, whereas a "duplex" document or copy sheet has a "page", and normally an image, on both sides.

The present invention is particularly suitable for precollation copying, i.e. automatically plurally recirculated document set copying provided by a recirculating document handling system or "RDH". However, it also has applicability to non-precollation, or post-collation, copying, such as post-collation operation of an RDH or semiautomatic document handling (SADH) as discussed in references cited herein. Post-collation copying, or even manual document placement, is desirable in certain copying situations, even with an RDH, to minimize document handling, particularly for delicate, valuable, thick or irregular documents, or for a very large number of copy sets. Thus, it is desirable that a document handler for a precollation copying system be compatible with, and alternatively usable for, postcollation or SADH and manual copying as well.

Precollation, collation, recirculative, or RDH copying, as it is variably called, is a known desirable feature for a copier. It provides a number of important known advantages. In such precollation copying any desired number of collated copy sets or books may be made by making a correspnding number of recirculations of the set of documents in collated order past the copier imaging station and copying each document page (normally only once, or twice) each time it circulates over the imaging station. The copies therefrom may automatically exit the copier processor in proper order for stacking as precollated sets, and thus do not normally require subsequent separation and collation in a sorter or collator. On-line finishing (stapling or stitching and/or gluing or other building) and/or removal and stacking and offsetting of completed but unfinished copy sets may thus be provided while further collated copy sets are being made in further circulations of the same document set. However, a disadvantage of such precollation copying systems is that the documents must all be repeatedly separated and circulated sequentially for copying in a predetermined order, by a number of circulations equivalent to the total desired number of copy sets. Thus, greatly increased, faster, and more critical document handling is necessitated for a precollation copying system, as compared to a post-collation copying system.

In contrast, in a post-collation copying system, such as with an ADH or SADH document feeder, or an RDH being operated in an SADH operation, multiple copies may be made at one time from each document page fed to the platen, and therefore multiple document recirculations are not required for multiple copies. The document set need only be manually or semiautomatically fed to the imaging station once, if the number of copy sets being made is less than the number of available sorter bins. However, if the resulting copies are to be collated, they must then be collated by being individually placed in separate bins of a multiple bin sorter. Thus a serious disadvantage of post-collation is that the number of copy sets which can be made in one document set feeding or circulation is limited by the number of available sorter bins, and each bin must have a sheet capacity equal to the maximum number of documents in the document set being collated, since each bin must hold a completed copy set. Also, a multi-bin sorter adds space and complexity and is not well suited for on-line finishing. However, post-collation copying is desirable in certain copying situations, as previously noted.

A recent RDH, with an alternative SADH input, and a measured-stop registration system, is taught in U.S. Pat. No. 4,579,444 issued Apr. 1, 1986 to T. S. Pinckney and H. J. Sanchez. This is in addition to the cross-referenced applications cited above, and references cited therein. Some further examples of Xerox Corporation RDH are U.S. Pat. Nos. 4,459,013 issued July 10, 1984 to T. J. Hamlin et al; 4,278,344 issued July 14, 1981 to R. B. Sahay; and 4,579,444, 325 or 326. Some other examples of recirculating document handlers are disclosed in U.S. Pat. Nos. 4,076,408; 4,176,945; 4,428,667; 4,330,197; 4,466,733 and 4,544,148. A preferred vacuum corrugating feeder air knife, and a tray, for an RDH, are disclosed in U.S. Pat. Nos. 4,418,905 and 4,462,586. An integral semi-automatic and computer form feeder (SADH/CFF), which may be an integral part of an RDH, as noted in Col. 2, paragraph 2, therein, is disclosed in U.S. Pat. No. 4,462,527. Various others of these patents teach plural mode, plural input, RDH/SADH, document handlers, such as the above cited U.S. Pat. No. 4,176,945 issued Dec. 4, 1979 to R. Holzhauser; and the below cited U.S. Pat. Nos. 4,192,607 to Hage and 4,350,329 to Holzhauser et al.

As to prior art on loading an RDH from documents fed into an ADH document feeding entrance of the RDH, from a bottom document stack feeder, and document ejection from the RDH after copying, particularly noted in the incidental disclosure thereof in U.S. Pat. No. 4,093,372 issued June 6, 1978 to Joachim Guenther, especially Col. 8, inter alia. Note however, that this is not a conventional RDH. Documents are loaded onto a shingling transport, not into an RDH tray. Also, there is no suggestion of job batching. U.S. Pat. No. 4,391,504 issued July 5, 1983 to the same Thomas Acquaviva is also noted, for its showing of feeding the copies (not original documents) into what appears to be an SADH input of an RDH, and is described as doing so for stacking them in the RDH tray for subsequent copies, but this is for making subsequent copies of the copy sheets rather than original document sheets. Although XDJ Vol. 11, No. 1, pp. 41–42, January/February 1986 by Robert J. Michatek relates to special programming utilizing the SADH input of an RDH, in that system the set of originals are ejected to the SADH output tray and must be manually removed therefrom by the operator and placed manually in the RDH stacking tray, for each job.

U.S. Pat. No. 4,126,390 issued Nov. 21, 1978 to John. L. Connin by Eastman Kodak discloses a job batching system which is a large and complex system for automatically sequentially loading separate document jobs and separate programming therefore into the RDH tray of a RDH document handler, and ejecting the documents after the job run. This patent also indicates that each job is programmed with a cover sheet read by a matrix reader. Unattended operator job batching with separate copying conditions (separate job programming) for a copier with an automatic document feeder and sorter (not an RDH) is disclosed in U.S. Pat. No. 4,693,590 issued Sept. 15, 1987 to S. Umeda (Ricoh Company).

U.S. Pat. No. 4,568,172 issued Feb. 4, 1986 to the same Thomas Acquaviva is of interest as disclosing a system for copying more than one document set at a time commonly loaded into the RDH tray together, to combine small RDH jobs for improved efficiency, and then separating their copies. This system may be used with or combined with the system disclosed herein.

Xerox Disclosure Journal Publications of particular interest relating to job batching systems for automatically sequentially loading separate jobs into a document handler and/or special programming include XDJ Vol. 7 No. 1 p. 7 January/February 1982 and XDJ Vol. 7, No. 6, p. 359 November/December 1982 by the same Thomas Acquaviva; XDJ Vol. 6, No. 4, p. 169–70 July/August 1981 by Denis J. Stemmle; and XDJ Vol. 11, No. 1, pp. 41–42 January/February 1986 by Robert J. Michatek, using the SADH input of the RDH as noted above.

However, in spite of such suggestions in non-conventional and non-commercial patent literature, it has remained commercially conventional to separately manually load each set of documents into the RDH tray for each job, and remove same, necessitating the presence of the copier operator at the beginning of each precollation copying job. [This should not be confused with the ability of some copier document handlers such as on the Canon "8550" copier, to accept and feed an intermixed set of different individual original sheets.]

A suitable automatic job batching system should be simple and compact and yet be able to accommodate and automatically handle the preloading of a substantial number of widely varying jobs which can be run in RDH modes even if some jobs are too large for all the documents in that set to be loaded all at once into the RDH document recirculation and restacking tray. The present system provides a fully automatic system for handling a large number of separately programmed document set jobs irrespective of the size or number of documents in the document sets, even if this number exceeds the RDH capacity.

Referring to prior art on marked slip sheet special programming, by reading and non-copying the slip sheets as they are fed to the RDH intermixed with regular original sheets, this is particularly the subject of Xerox U.S. Pat. No. 4,248,528 issued Feb. 3, 1981 to R. Sahay.

An early example of copier job programming sheets in Ricoh U.S. Pat. No. 3,687,540 issued Aug. 29, 1972 to H. Hashimoto—note FIGS. 2–3. The even earlier 1964 German patent of addition U.S. Pat. No. 1,156,314 to Helmut Rankers discloses an opaque or metalized control sheet pasted onto the last sheet in a stack of originals being recirculatively copied for automatic sensing for document recirculation count. Also noted is a "Research Disclosure" publication No. 18348 of July 1979 re marking certain originals with invisable dyes or inks sensed by a special scanner in the document handler to signal control logic to alter copier parameters. Also, a document feeder test calibration by a sheet with two cut-outs for registration sensors is disclosed in "Research Disclosure" No. 25008 February 1985, p. 90.

Additional prior art relating to special programming in general includes the earlier Eastman Kodak copiers "star" or asterisk button programming system, which can be used for chapterization, etc., as described in U.S. Pat. No. 4,640,607 issued Feb. 3, 1987 to R. L. Bray, originally filed Dec. 27, 1983, and the alternative EK "300" copier exception slip sheet insert option introduced in June 1986. The Kodak "300" copier exception slip sheet insert is an option which may be used instead of STAR special job programming. As understood, for the latter, special sheets which Kodak markets have a cut-out at the top. When inserted in the stack behind the original to be "excepted", and run through the RDH, this slip sheet can program that original to be copied onto paper fed from a different tray. When this slip sheet is turned over so that the hole is at the bottom, that following original is programmed to be skipped. The slip sheet itself is not copied, but is ejected into the SADH exit tray. See Eastman Kodak U.S. Pat. No. 4,763,161 issued Aug. 9, 1988 to P. H. Forest, et al re the above.

U.S. Pat. No. 4,688,924 issued Aug. 25, 1987 to S. Anzai et al, and U.S. Pat. No. 4,609,283 issued Sept. 2, 1986 to T. Murata et al, are particularly noted as pertinent to the concept of an automatic plural job stacking document input tray at one side of a platen and a document collection tray at the other side of a platen, for a document handler over the platen, wherein this arrangement is used for multiple job batching and unattended copying by means of a coded program sheet that leads each job from the input tray. The former is also noted for showing a vertical elevator movement of the plural job document collection tray. However they both relate to non-RDH document handlers and the use of a sorter, i.e., are not capable of precollation jobs. The following references are also of significant interest: U.S. Pat. No. 4,310,235 to Lorenzo et al, especially re readable job card programming; and the above cited U.S. Pat. No. 4,192,607 to Hage, especially re SADH document auto interrupt input to a plural mode RDH/SADH; and the above cited U.S. Pat. No. 4,350,329 to Holzhauser et al, especially re plural document inputs to a plural mode RDH/SADH. The following additional references may be of collateral interest: U.S. Pat. No. 4,201,464 to Botte et al; U.S. Pat. No. 4,211,483 to Hannigan et al; U.S. Pat. No. 4,285,591 to Botte et al; U.S. Pat. No. 4,568,172 to Acquaviva; and U.S. Pat. No. 4,639,125 to Okuda et al.

Also noted is German OLS DE U.S. Pat. No. 3,630,384 A1 laid open 19.3.87, based on Japanese App. No. 198297/85 (6.9.85) by Kitajima, et al (Canon K.K.), which appears to provide for plural stacked job input to a copier document handler. [No English language equivalent is presently known to be available.]

Of background interest, J. Guenther, U.S. Pat. No. 4,212,457 issued July 15, 1980 is programmed to select between precollation or post-collation (multibin) modes, depending on the number of copy sets desired. The machine in the above cited A. J. Botte, et al., U.S. Pat. No. 4,285,591 issued Aug. 25, 1981 (IBM), is programmed to automatically segment the collator job when the number of document sets desired exceeds the capacity of the collator. U.S. Pat. No. 4,156,133 issued May 22, 1979 to E. L. Legg has variable operating programs for specific copy runs.

U.S. Pat. No. 4,248,525 to Sterrett (Kodak) discloses a programmable apparatus for producing sets of copies from a set of document sheets, some of which copies can be produced in an RDH precollating mode by means of a recirculating feeder, and others which cannot be produced in a collating mode. The copies that are produced in a non-collating mode are stored temporarily. Programming controls the making of copies in a collating mode and the delivery of copies temporarily stored so that the copies arrive at a receiver or finisher in collated sets of copies with the page order of the copy sets corresponding to the page order of the document set. A copy storage section 14 has a plurality of deflectors 96 for deflecting copy sheets into plural temporary storage bins 82. Copy sheets are then delivered from the bins 82 to a finisher 16.

The present system is suitable for, and is herein disclosed with, a "dual flash" precollation copying and finishing system embodiment, although not limited thereto. This disclosed embodiment is that of the copending above cited Ser. No. 098,096, describing in further detail this "dual flash" RDH precollation copying system with an integrated plural bin on-line finisher unit. Also noted thereon are Xerox Corporation U.S. Pat. Nos. 4,566,782 issued Jan. 28, 1986 to J. Britt et al, and 4,558,942 issued Dec. 17, 1985 to Bernard Chiama. In a "dual flash" system, two copies are normally made of each document in each circulation of the document set, rather than one, and alternatively separated in their outputs, to produce two precollated copy sets at a time from each document set circulation rather than the usual one. The term "dual flash" generally refers to two directly successive exposures of the same document to make two identical copies. Scanning exposure can, of course, be used instead of flash exposure.

The present invention overcomes various of the above-discussed and other problems, and provides various of the above features and advantages.

A feature of the specific embodiment disclosed herein is to provide a document job handling system for a precollation copier with a recirculating document handler for recirculating and repeatedly sequentially presenting documents to the platen of said copier for copying, wherein said recirculating document handler has a document stacking tray adapted to receive for said recirculative precollation copying a set of documents loaded therein of up to a preset capacity number, and wherein said recirculating document handler also has a separate, alternate, document entrance for receiving documents and feeding them to said platen for non-recirculative, non-precollation, copying, and document ejection means for ejecting documents from said recirculating document handler which have been fed to said platen from said alternate document entrance, the document gate means for selectably feeding documents to said document ejection means or to said document stacking tray, and control means for controlling the operation of said recirculating document handler; said document job handling system comprising document job batch loading means operably connecting with said alternate document entrance, said document job batch loading means comprising stacking means for stacking a plurality of document set jobs, and document job feeding means for sequentially feeding documents individually from a stack thereof in said stacking means to said alternate document entrance job mode; selection means communicating with said control means to provide information for said control means for documents being fed by said document job feeding means to said alternate document entrance to determine to whether to operate said recirculating document handler to copy those documents in a recirculative precollation copying mode or a non-recirculative, non-precollation, copying mode; said control means, when said documents being fed by said document job feeding means to said alternate document entrance are so determined to be copied in a recirculative precollation copying mode, operating said recirculating document handler and said document gate means thereof to automatically sequentially load said documents being fed by said document job feeding means to said alternate document entrance into said document stacking tray, up to said preset capacity number, and then to automatically recirculate and repeatedly sequentially present said documents to said platen of said copier for copying, and then to automatically eject said documents from said recirculating document handler with said document ejection means.

Further features provided by the system disclosed herein, individually or in combination, include those wherein said job mode selection means includes job separation means communicating with said control means to indicate the feeding of separate document jobs by said job batch loading means; wherein if the number of said said documents being fed by said document job feeding means to said alternate document entrance for a single precollation copying job exceeds said preset capacity number of said document stacking tray before said job separation means communicates with said control means to indicate the feeding of a separate copying job, said single precollation copying job is automatically divided into separately recirculated sub-job sets of documents of a number not exceeding said preset capacity number of said document stacking tray, and said documents being fed by said document job feeding means to said alternate document entrance are automatically interrupted during said recirculations of said separately recirculated sub-job sets of documents; wherein said job separation means comprises slip sheets interleaved between separate document jobs and and fed with said document sheets from said document job batch loading means, and slip sheet detecting means for detecting said feeding of said slip sheets; wherein said mode selection means includes selectable variable job information indicia on said slip sheets, and slip sheet information indicia reading means for reading said selectable job information indicia on said slip sheets for controlling said control means to variably copy documents fed after a said slip sheet is so read in accordance with said selectable variable job information indicia thereon; wherein said stacking means for stacking a plurality of documents and document set jobs in said document job batch loading means is adapted to commonly stack all documents job sets face down in a common stack thereof, and said document job feeding means comprises a top feeder for sequentially feeding the topmost document sheet in said common stack in said stacking means directly to said alternate document entrance of said recirculating document handler without inversion; and/or wherein said job handling system further includes job output inverting and stacking means for commonly stacking all said document set jobs face up in a common stack thereof after said automatic ejection of said documents from said recirculating document handler with said document ejection means.

Further features provided by the system disclosed herein, individually or in combination, include those wherein, in a copying method for sequentially recirculatively presenting document sheets to the platen of a copier for precollation copying with a recirculating document handler, wherein said recirculating document handler has a document stacking tray into which a set of document sheets is loaded for said recirculative precollation copying, up to a preset document sheet capacity number, and wherein said recirculating document handler also has a seperate, alternate, document entrance for receiving document sheets and feeding them to said platen, and document ejection means for ejecting document sheets from said recirculating document handler after their copying, and document gate means for selectably feeding document sheets to said document ejection means or to said document stacking tray, and control means for controlling the operation of said recirculating document handler; an automatic document job batching system comprising the steps of: stacking document sheets to be copied as a batched plurality of document set jobs in a job loading input adjacent said recirculating document handler; sequentially feeding said document sheets individually from said job loading input to said alternate document entrance; selecting whether to operate said recirculating document handler to copy said document sheets fed from said job loading input in a recirculative precollation copying mode or in a non-recirculative, non-precollation, copying mode; when said document sheets being fed from said job loading input are selected to be copied in a recirculative precollation copying mode, operating said recirculating document handler and said document gate means thereof to automatically sequentially load a document set job of said document sheets into said document stacking tray, up to said preset document sheet capacity number, and then automatically recirculatively copying those document sheets, and then automatically ejecting those document sheets from said recirculating document handler with said document ejection means; when said document sheets being fed from said job loading input are selected to be copied in a non-recirculative non-precollation copying mode, operating said recirculating document handler and said document gate means thereof to automatically sequentially copy and then eject those document sheets from said recirculating document handler with said document ejection means without recirculation and without loading those document sheets into said document stacking tray; and then automatically feeding further document sheets from said job loading input into said alternate document entrance for copying in a selected said recirculative precollation copying mode or non-recirculative non-precollation copying mode; and/or wherein if the number of said said documents being fed from said job loading input to said alternate document entrance in a single document set job exceeds said preset document sheet capacity number of said document stacking tray, said document set job is automatically divided into separately loaded in said document stacking tray, and seperately recirculated, sub-job sets of document sheets of a number not exceeding said preset number, and the documentsheets being fed from said job loading input to said alternate document entrance are interrupted during said recirculations of said separately recirculated sub-job sets of document sheets; and/or wherein slip sheets are interleaved between separate document set jobs in said job loading input and fed with said document sheets fed from said job loading input to automatically indicate separate document set jobs and maintain job separations; and/or wherein said slip sheets contain selectable variable job infomation indicia which is read to control variable copying of documentsheets fed after a said slip sheet is so fed and read; and/or wherein said plurality of document set jobs are commonly stacked face down in a common stack in said job loading input and the document sheet thereof are fed sequentially from the top of said common stack to said alternate document entrance of said recirculating document handler without inversion; and/or wherein said document set jobs are stacked face down in said job loading input and the document sheets thereof are top-fed sequentially to said alternate document entrance of said recirculating document handler without inversion; and wherein after said copying thereof they are ejected with said document ejection means and inverted and restacked face up; and/or wherein said stacking of a plurality of document set jobs comprises intermixing and commonly stacking individual document jobs and separate plural document jobs and interleaving slip sheets.

Some examples of various other prior art copiers with document handlers, and especially with control systems therefor, including document sheet detecting switches, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in this art, and in general, how to program and execute document handler and copier control functions and logic with conventional or simple software instructions for conventional microprocessors. This is taught by the above and other patents and various commercial copiers. Such software may vary depending on the particular function and particular microprocessor or microcomputer system utilized, of course, but will be available to or readily programmable by those skilled in the applicable arts without experimentation from either descriptions or prior knowledge of the desired functions together with general knowledge in the general software and computer arts. It is also known that conventional or specified document handling functions and controls may be alternatively conventionally provided utilizing various other known or suitable logic or switching systems.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below. The present invention will be better understood by reference to this description of this embodiment thereof, including the drawing figures(approximately to scale), wherein:

FIG. 1 is a frontal schematic view of an exemplary copier with an exemplary document handler with which the subject system may be incorporated as shown in the example of FIG. 4. The document handler is an integral plural mode and dual input RDH/SADH, capable of precollation or postcollation modes of operation, copying simplex or duplex documents, in simplex or duplex copying, and also capable of copying from computer form document web feeding (CFF);

Describing now in further detail the specific example illustrated in FIGS. 1–4, there is schematically shown an exemplary copier 10, with an exemplary document handling system 20 comprising a plural mode RDH to be further described herein. The copier 10 may be of any known type, such as those disclosed in above-cited copier patents, although a high capacity type with high capacity on line finishing such as is shown herein is greatly preferred. The exemplary DH 20 illustrated here is similar to that shown in the above cross-referenced U.S. Ser. No. 029,027, or the generally comparable disclosures in U.S. Ser. No. 029,026, both filed Mar. 23, 1987. It is a dual input RDH/SADH document handler, and this general type is shown in various above cited patents thereon such as U.S. Pat. No. 4,579,444, etc. As shown therein, it is previously known to have two separate document loading inputs, a recirculating or RDH input stacking tray 21, and a document side entrance 22 for semi-automatic document handling (SADH), into which documents may be individually sequentially inserted by the operator, or from a stack feeder. This SADH mode of input may be may be automatically selected by document input there, or manually operator selected, or selected in an "job interupt" mode. In the present system it is selected in a job batching mode, which also automatically operates both the RDH/SADH document handler and its copier differently from these previously known operating modes.

Figure 2:
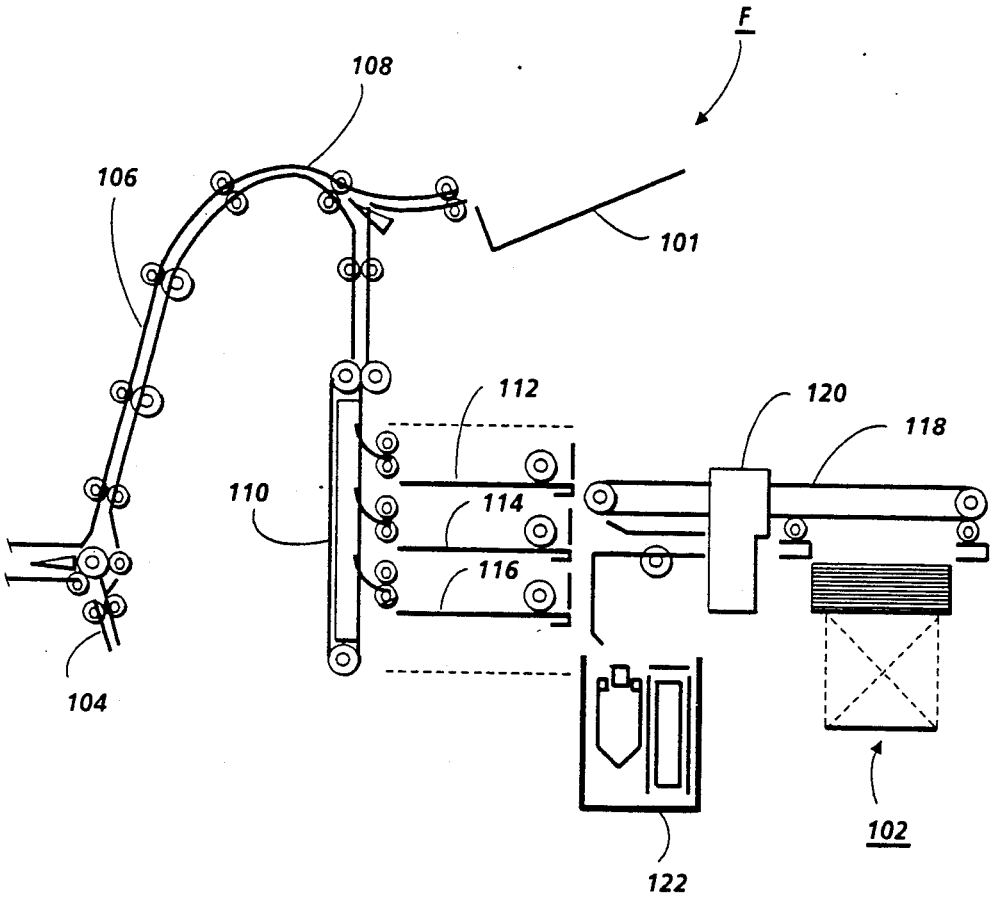
FIG. 2 is a frontal schematic view of an exemplary finisher for the copier example of FIG. 1.

Referring for convenience especially to FIG. 2, the RDH 20 provides for automatically transporting individual registered and spaced document sheets onto and over the conventional platen imaging station 23 of the copier 10, preferably using a belt platen transport 32 overlying the platen 23. Documents are inputted to one end of the platen transport 32 either from the RDH input provided by the restacking tray 21 on top of the unit, spaced above the platen, or from the separate document input 22 directly adjacent one side of the platen, shown at the right side here. That second input 22 is referred to herein as the "slot" or SADH input 22, although it is not limited to semi-automatic document input feeding. As will be described, this input 12 is also used for job batching input in the system here, fed from an automatic document stack feeder (ADF) 72. This SADH input 22 may optionally be used for larger documents, optionally inserted short edge first, or CF web, etc.

As is conventionally practiced, the entire document handler unit 20 pivotally mounts to the copier so as to be liftable by the operator up away from the platen for manual document placement and copying, or jam clearance of documents jammed in the platen area.

The particular DH system 20 shown here has the additional ability to do mid form CF starts at any desired panel of a CF web. It can do this because when the DH unit is opened the feed roll nips at opposite sides of the platen open, with the drivers lifting up with the platen cover unit 25 and the idlers unconventionally remaining on or below the copier 10 surface, and the operator has full unobstructed access to the platen 23 and an open document path thereacross.

Figure 1:
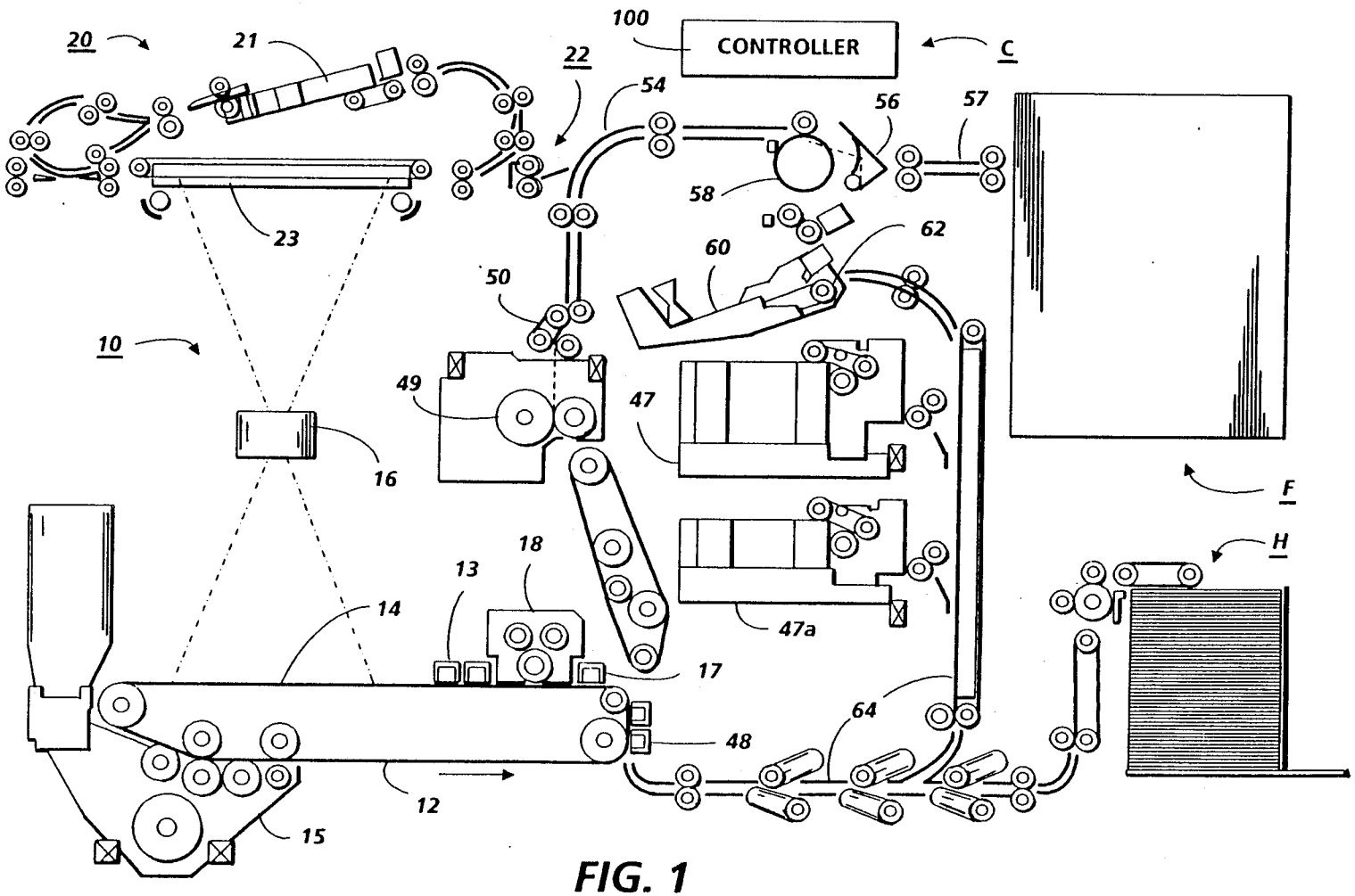

Referring to FIG. 1, other than the DH 20 document system modifications and controls and other features to be described herein, the exemplary copier 10 may be, for example, the well known "Xerox" "1075" or "1090" or any other xerographic or other copier, as illustrated and described in various patents cited above and otherwise, including U.S. Pat. No. 4,278,344 and others. The exemplary copier 10 may conventionally include a photoreceptor belt 12 and the conventional xerographic stations acting thereof for respectively charging 13, image exposing 14, image developing with toner 15, precleaning discharge 17, toner cleaner 18, etc.. Documents on the platen 23 may be imaged onto the photoreceptor 12 at area 14 through a varible reduction ratio optical imaging system 16 to fit the document images to the selected size of copy sheets. The copier 10 is adapted in a generally known manner to provide duplex or simplex precollated or postcollated copy sets from either duplex or simplex original documents copied using the RDH 20, as furthr described herein.

The control of all copier and document hander and finisher operations is, conventionally, by the machine controller. The controller, "C", reference 100 here, preferably comprises a known programmable microprocessor system, as exemplified by the previously cited art. Plural but interconnecting microprocessors at different locations may be used. The controller controls all of the machine steps and functions described herein, including all sheet feeding. This includes the operation of the document feeder 20, document and copy sheet gates, feeder drives, and finisher "F", etc.. As further taught in those references, the controller also conventionally provides for storage and comparison of the counts of the copy and document sheets, the number of documents fed and recirculated in a document set, the desired number of copy sets, and other selections by the operator through a connecting panel of control switches (usually in a copier console or panel), time delays, jam correction and job recovery control, etc. Numerous conventional path sensors or switches are utilized to help keep track of the position of the document and the copy sheets and the operative components of the apparatus by connection to the controller. For example, the controller may be conventionally connected to receive jam, timing or positonal and other control signals from various document sheet sensors in the document recirculation path of the RDH, such as those shown in respective locations here in FIG. 3. These sensors as conventionally schematically illustrated here as a small arrowhead or triangle. In addition, the controller variably regulates the positions of sheet path selection gates depending upon which mode of operation is selected and the status of copying in that mode. The controller also conventionally operates and changes displays on a connecting instructional display panel portion thereof.

Figure 3:
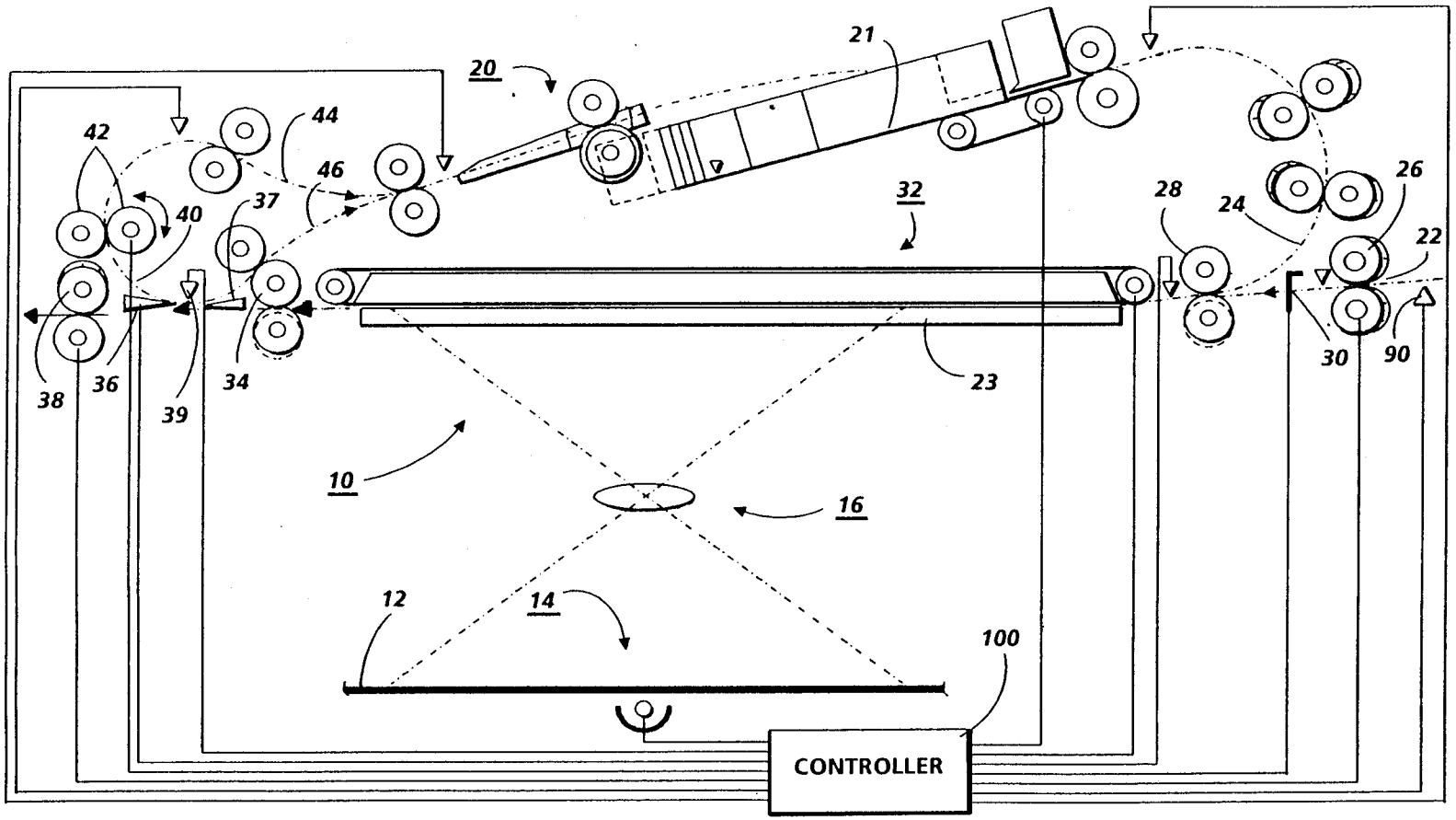
FIG. 3 is an enlarged view of the document handler of FIG. 1.

Referring further to the exemplary plural mode document handling system 20 illustrated enlarged in FIG. 3, it may be seen that documents may be fed to the same platen 23 and platen transport 32 input positions from either the SADH input 22 at one side of the RDH unit, or from the regular RDH input—the loading or stacking tray 21 on top of the RDH unit. The latter input is through an RDH input path 24 between that tray 21 and the upstream end of the the platen transport 32, preferably including, as shown, a known stack feeder/seperator, a sensor, and a first set of turn baffles and feed rollers to invert the documents before copying. The SADH input 22 may conventionally include a tray and edge guide and sensors and an SADH preregistration gate 30. This gate 30 may have any of the various configurations and operating mechanisms illustrated in various of the prior art references on registration gate systems. The gate 30 illustrated here is preferably retractable in and out of the SADH input path to the platen from the SADH input 22 by solenoid actuation controlled by the controller 100. The SADH input path feeds in documents directly to the platen, without inversion, and bypassing, without interference, the RDH input path 24, so that the two inputs can automatically operate in a selected interleaved or interrupt feeding sequence.

The SADH input 22 here preferably also includes slightly skewed cross-rollers 26. As taught in the above-cited U.S. Pat. No. 4,579,444, these provide side edges registration towards a rear edge guide at this input, as well as feeding of the document forward for registration and deskewing against the gate 30. Such cross-rollers may also be provided in the RDH input path 24. Just downstream of the gate 30 are take-away or on-platen rollers 28 providing a document sheet feeding nip for engaging and transporting any document sheet which is past the gate 30 or the RDH input path 24. The rollers 28 feed the documents past a sensor directly into the input to the platen transport system 32. Preferably the platen transport system 32 here comrpises plural vacuum belts for engaging and transporting the documents without slippage over the platen 23 into the desired registration position, of the general type disclosed in U.S. Pat. No. 4,618,138, etc. The platen transport system 32 and the rollers 28 may be incrementally servo motor driven by the controller 100 in a manner taught by various of the above-cited references.

After the documents are copied on the platen 23, they are, in this example, ejected by the platen transport system 32 into downstream or off-platen rollers 34 and fed past a gravity gate 37 and sensor 39 to a decision gate 36. If the gate 36 is up (it always is for CF or normal SADH copying) it guides the documents directly to an SADH document output path including output eject rollers 38 which eject the documents into an output stacking tray. If this decision gate 36 is actuated down, as for RDH, the documents are instead deflected by this gate into an RDH return path 40, past a further sensor.

This RDH return path 40 includes reversible rollers 42 to provide a choice of two return paths to the RDH tray 21; a simplex return path 44 with an inversion, or a duplex return path 46 without an inversion. For the duplex path 46 the rollers 42 are reversed to reverse feed the previous trail edge of the sheet back to the now-dropped gate 37 which now deflects that sheet into the path 46. The duplex return path 46 provides a desired circulation inversion of duplex documents, as returned to the tray 21, for copying their opposite sides in a subsequent circulation, or circulations, as described in the above-cited art. This is because a duplex document returned through the duplex return path 46 has only one inversion per circulation (in the RDH input path 24). In contrast, in the complete simplex circulation path there are two inversions per circulation, one in each of the paths 24 and 44, which equals no inversion per circulation. Thus, simplex documents are always returned to tray 21 in their original, face up, orientation.

It will be seen that the respective document paths and the tray 21 include various sensors for counting and/or sensing the lead edge and/or trail edge of the document sheets. These sensors are schematically illustrated here by the conventional representation of an arrowhead or triangle. All of these sensors are, of course, conventionally connected to the controller 100 to be utilized in the operation of the DH system 20. As illustrated, the RDH tray 21 here also includes a variable position rear registration edge or backstop, illustrated here with several dashed lines, for initially accommodating and restacking various sizes of documents. The illustrated DH system 20 utilizes for its RDH feeding a known combined corrugated vacuum feeding and air knife separator system for feeding out sequentially the bottom-most sheet of the stack in the tray 21, as described in various of the above-cited references.

As noted the SADH input 22 path includes side (rear edge) registering cross-rollers 26. This same SADH input 22 is normally desirably commonly used here for CF web input also, since it provides for basically planar or straight through web feeding of CF web, and can utilize these same cross-rollers 26, but rollers 28 and 34 may be disabled, as shown by their dashed line positions. For normal cut sheet SADH input 22 document feeding in the DH system 20, the documents are fed and controlled by, in order, the cross-rollers 26, the nips of the on-roll rollers 28, the platen vacuum belt transport 32, the nips of the downstream or off-roll rollers 34, and then the nips of the output or exit roll rollers 38. For RDH circulation the sheets are additionally driven and controlled by the stack feeder/separator and the rollers and curved baffles in the paths 24, 40 (rollers 42) and 44 or 46, and the eject rollers at the restack entrance at the rear of the tray 21, as illustrated. Individual sheets are "handed off" from one feeding nip to another along the document path with very restricted slippage to ensure positive and registered feeding. All of these latter nips and baffles are preferably and conventionally designed to open for jam clearance access and sheet removal when their respective DH 20 covers are opened.

In the system illustrated here, the portions of all the roller pair units 26,28,34 and 38 which are below the document path are idler rollers mounted to the body of the copier. All the above-path rollers in each of these nip pairs are the driven rollers, and all of those are mounted to the pivotal platen cover unit of the DH system 20. Thus, these above-path rollers may all be lifted up, away from the platen 23, to expose it and to open all these roller nips and the platen transport 32. Furthermore, the below-path idlers of the rollers 28 and 34 are desirably movable by motor/cam or solenoid retractors to the dashed-line positions shown, so as to open those nips for CFF even when the DH system 20 is pivoted down into its closed, operating, position. This opening of the on-roll 28 and off-roll 34 nips is done automatically as part of the CFF mode of operation, and can also be done temporarily after a jam is detected in normal RDH or SADH operation to assist jam clearance.

Turning now to details of the exemplary job batching system disclosed herein, there is disclosed a simplified method of document job batching for a precollating output copier with a recirculating document handler, with features as previously described above in the introduction. Specifically, there is provided a system and method for plural document job batching for continuous runs of several jobs one after another without any required operator intervention, including automatic sequential job loading of a recirculating document handler from an SADH document input, and alternative intermixed SADH operation. The documents proceed to completion of their cycles, and may be ejected into an output tray to restack. The machine takes over to finish all the jobs once the jobs are loaded into a job input. No individual removal or reordering of the document sets is required. This disclosed system and method utilizes the separate SADH input 22 for the RDH document handler 20 and the platen transport 32 and the RDH gates to either automatically load the RDH input tray 21 for RDH jobs or feed through SADH jobs. In either case, additional jobs may be loaded on top of the existing, waiting, input job stack while previous jobs are either being recirculatively copied in the RDH mode or copied in the SADH mode.

Figure 4:
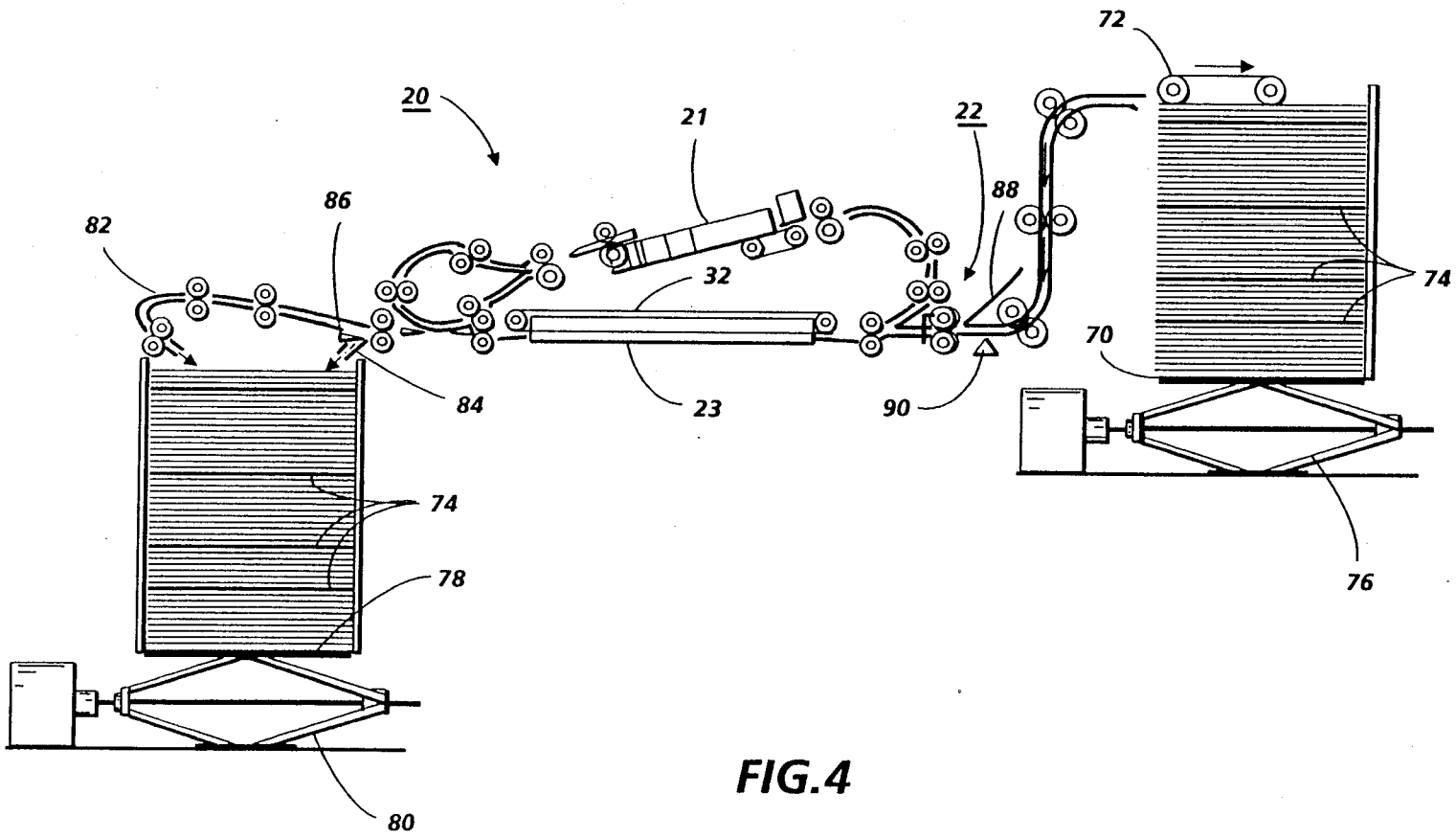
FIG. 4 is a frontal schematic view of an example of the subject job batching system incorporating the document handler of FIGS. 1 and 3.

Disclosed in FIG. 4 is a job input tray 70 adjacent the SADH input 22, into which plural jobs (document sets) are loaded in a single job input stack separated only by slip sheets 74. A job input feeder 72 feed both the documents and the slip sheets 74 into the SADH input 22 via a conventional sheet transport path therebetween. The job input tray 70 may have an optional stack elevator 76 to raise the stack level to the feeder 72 as the stack depletes, or the feeder 72 may float down as the stack depletes. As documents are ejected from the DH 20 output 38 after copying they are stacked in job output tray 78. This tray 78 may optionally have a job output stack elevator 80 to maintain an appropriate stack restacking heigth for small to large stacks. All documents are normally sequentially ejected and stacked after copying via an output inversion path 82 with a natural inversion, so that all job batched documents (all documents fed from job input tray 70) may be fed in, copied, and exited face down, and in N-1 order, yet restack in job output tray 78 collated, in their original and proper order, by being stacked face up in tray 78.

Also disclosed here as optional additional features are an alternative, non-inverting, restack path 84, selected by actuating an optional restack path gate 86. Gate 86 may be actuated automatically in response to the operator inserting a document into an optional alternative SADH manual input 88, since such manual stream feeding SADH input of documents is normally in 1-N order.

As previously indicated, this system desirably enables a copier operator to leave a single large stack of documents (originals), which may include several different job sets of documents, which may need to be differently copied, unattended at an input station (here job input tray 70) for the document feeder 20, and then the copier will automatically copy the requisite number of copies of all of these documents and/or document sets without further operator attendance or input. The specific system disclosed here utilizes a dual mode type of RDH 20 which has both an RDH stacking input 21 and a separate SADH sequential document input 22. In the subject system for RDH job loading, a job feeder 72 in the SADH input tray feeds documents from the multi-document input or loading stack thereof into this SADH input 22, which then, if an RDH job is desired, instead of feeding the documents through to the SADH output 38, is specially programmed to divert these particular documents from the normal SADH path up into the RDH return and restack path 40,44, by deflection by gate 36. Thus these diverted documents stack load automatically into the RDH tray 21. Then the RDH recirculates them by the variably preselected number of times, and then after copying automatically unloads them into the SADH output rather than restacking them in the RDH tray 21. However, normal SADH modes of operation are also provided for those jobs for which it is desired. A dual mode or dual function SADH operation is thus provided.

However, as will be further explained, the number of these documents to be copied which are automatically loaded into the RDH tray from the job input tray in this above manner is limited by a combination of slip sheet controls or other means separating or otherwise identifying the job sets and a programmed maximum number of document sheets which the system allows to be loaded into the RDH tray at one time. The programming slip sheets may be premarked, or other types of preprogramming systems disclosed herein may be utilized. That is, the job to be recirculated in the RDH at one time is either a separate job, so indicated by a slip sheet or otherwise, or part of a larger job automatically broken up into smaller subsets thereof of a number of sheets which may be recirculated at one time in the RDH. Both types of jobs may be automatically ejected out the SADH output after the desired number of pre-collated copies have been made therefrom.

In the case of said large RDH jobs separated and recirculated in subsets, the finisher may be partially disabled to assist subsequent manual or automatic final assembly of the subset copies into final collated sets for finishing. (Note that each subset is internally collated, so that this is still much simpler than manual collation of SADH generated multiple copies.)

Once a job batching input is selected, by the operator actuating a controller switch therefore, or inserting a machine readable job sheet, or otherwise, the copier then automatically goes into a job batching mode, to operate as will be described herein. The operator is then preferably selectively sequentially instructed in a known manner by a known variable control panel display, such as a verbal and pictoral CRT or liquid crystal screen display interconnecting with the controller 100. That is, the operator may be instructed by the display to either place the removed document(s) face down or face up in the SADH input (the RDH slot) 22 rather than the RDH document tray under certain selected and defined conditions, or to place them in the RDH tray 21 for other defined conditions.

These controller systems have the ability to deliver different messages, instructions, and routines to suit the needs of the particular operating mode for the job that is being run, and the circulation that is being run within the job. E.g., duplex to duplex copying is handled different than simplex to duplex, and within duplex to duplex, and single documents are handled differently than plural documents and plural document sets exceeding in size the capacity of the RDH tray are also handled differently with this system.

In addition to indicating a job break or RDH batch, (job separation) the slip sheets can be utilized to direct special programming of one or more or all the document sheets subsequent thereto. For example, indicating extra copies of certain sheets, special density or processing, selecting special paper size or stock, cover inserts, chapterization, margin or other image shifts, reductions, transparency copying and blank paper protective sheet inserts therefor, type of finishing, etc. The slip sheet can also be used to direct and/or interrupt an RDH or SADH document feeding run of subsequent documents. It can be utilized to stop the copying run entirely after a selected number of documents so as to allow manual inserts such as photographs, chapter ends, tapage separators, or special covers to be inserted.

Another potential use of slip sheets in this system is to separate plural sets of "make ready" copies (copies of originals copied in lieu of originals). This can alternative be combined with an automatic limit on the maximum number of recirculations allowed per RDH set in the the RDH mode to avoid document wear problems. For example, if 2000 precollated copies are needed of an original set, but the particular RDH causes visable document wear after 500 circulations, four "make ready" copy sets can be made from that document set and stack loaded in the job batching input separated by four slip sheets and fed in by this system to automatically make the 2000 copies. Alternatively, only one slip sheet is needed if the RDH automatically ejects and reloads after 500 circulations.

If only one copy is to be made of the particular job, or if a very large number of copies are to be made from certain documents, or if a particular job is only a one or two page document set, then either the slip sheets, or the preset programming of the job control system itself, or both may be programmed to switch automatically to an SADH mode for such jobs, in which the documents are not loaded into the RDH tray, but rather are left on the platen and sequentially multiple-copied and then directly ejected from the SADH output. In the case of duplex copies, the slip sheet can also be utilized to direct this to be done for pairs of subsequent sheets. For such SADH mode operation the documents must be loaded face down in the job input stack, for face down input, since face down copying must be provided.

As an alternative, face up loaded and inputted documents, even for such SADH copying, could be circulated once for inversion through the RDH duplex path before copying them, but this is unproductive, risks jams for certain documents, and is not suitable for oversize documents.

Especially to provide the capability of handling very large input stacks, a top feeding stack feeder, 72 or the like, input is preferred for feeding documents into the SADH input 22. This top sheet feeder/separator 72 may be the same type of feeder as a "high capacity" type paper feeder, such as "H" shown in FIG. 1. Top feeding the job input from the job input tray 70 to the SADH for RDH jobs requires different handling than bottom feeder input for proper RDH document facing and order. Face down job stack loading is preferred for top feeding a conventional N−1 page order operating RDH/copier, because this provides N−1 order input loading. This input loading, through the (desirable) simplex RDH return path 40, 44, (the single natural inversion RDH path from the platen to the RDH tray), stacks these loading documents face up in N−1 order in the RDH tray 21. Since the RDH tray 21 has a bottom feeder output, this provides normal N to 1 page order RDH circulation and copying. Note that since document inverter operation is not required for loading the RDH in this case, that either an upstream or downstream document inverter location can be used. (A downstream inverter is illustrated here, and another is in the Xerox Corporation "5600" copier RDH, shown, e.g., in U.S. Pat. No. 4,330,197 to R. E. Smith, et al.)

Alternatively, face up input stack loading and top feeding for 1 to N input of RDH jobs may be used where the RDH has a downstream document inverter, as here, providing the RDH and copier can be operated in forward or 1−N order and still give collated output, as by using the copy sheet inverter in the output path of the copier, and if this can be done without interferring with proper-side copy sheet binding or hole punching in the output. Such face up input stack loading and top feeding for 1−N input order would use the downstream document inverter (the duplex path 40, 46) to provide face up stacking orientation in the RDH tray 21.

However, the preferred system disclosed herein desirably utilizes consistent face down input job stacking and top sheet feeding, for N−1 document order input, of all job batched documents, for both RDH and SADH copying. This eliminates any need for the RDH inverter operation (except, of course for inverting duplex documents). It also eliminates any productivity losses. All documents may copied while they are being loaded into the document hander and while they are being ejected, i.e., there are no non-copying RDH circulations required for inverting and restacking documents to establish or restore proper collation, either before or after copying, and normal N−1 document order RDH document presentation and copying order is provided. Furthermore, SADH jobs do not need to be reordered into 1−N loading order. Yet, all documents for all jobs are automatically restacked in proper collated order after copying with the output path 82 here. (As previously noted, if it is desired to provide an alternate manual SADH input 88, bypassing the job batching input, and feed in documents in 1−N loading order, and it is also desired to provide different stacking for collating the output of those particular special case documents, then an alternative gated 86 path 84 can be provided. However, this feature is purely optional, since collated stacking of manual SADH input 88 documents is not normally needed, since this alternative input 88 would normally only be used for a few documents, such as for a "job interrupt". Also, the operator could be instructed to feed documents N−1 (last page first) into input 88, thereby eliminating any need for gate 86 or path 84.

As noted, and shown in FIG. 4, very few changes to an existing dual input recirculating document handler copier system are needed for this job batching system. One is the addition of a top (or bottom) stack feeder 72, in the SADH input tray to the RDH, or in a separate but path connecting job stacking tray as illustrated. This feeder 72 maybe a simple, conventional, friction retard feeder, since it only needs to separate the originals once, or it could be a VCF (vacuum corrugating feeder) for high reliability. Another potential disclosed addition is a page mark reading sensor array 90 in the job input path, such as is illustrated here at the SADH input area 22. The purpose of this sensor array 90 is to read an operator programmed job control slip sheet 74, which indicates job run formats, if that optional system is utilized. (An example will be described below, and other examples are in the above cited art thereon.) A third proposed change is to expand the stacking capacity of the SADH output tray 78 to several hundred originals, and to provide a simple inversion path 82. Fourthly, conventional stack elevators such as 76 and/or 80 may be provided for the job input and/or output, stacking trays for improving the feeding and restacking of large, multi-job, stacks. These features may all be enabled at low cost with available technology. No hardware changes at all are required in the RDH per se.

Job batching may be done as follows (see FIG. 4): The operator is instructed to load all multiple or batched jobs face down in normal, collated order, stacked on top of one another, into the job input feed tray 70, and is also instructed that all separate jobs are preceeded by a programmed sheet 74 loaded on top of the job. Single sheet jobs are loaded face down to automatically run as SADH jobs. Multiple sheet but single copy jobs, likewise. Multiple sheet/multiple copy jobs (RDH jobs) are also loaded face down in this preferred and top feeding system. (Face-up loading is used only if an alternative above described RDH loading and operating system is selected). Preferably all documents and job sheets are all loaded the same, face down, for simplicity of loading and operation.

All non RDH (SADH) jobs are fed from the SADH input 22 onto the platen where each face down document sheet is successively imaged the required number of times. Immediately after imaging, each of these documents is exited into the SADH output tray 78 to restack there face up in collated order.

Each document sheet for one RDH job is first fed from the SADH input across the platen, diverted up by the RDH return diverter gate and fed into the RDH feed tray, face up, to restack there. The RDH tray is now loaded, and the RDH job is run i.e., these originals are all plurally recirculated a number of times corresponding to the number of copy sets needed, with each document being copied once or twice in each circulation, to provide precollated copy output. Either simplex or duplex originals may be loaded and copied. When this RDH job is complete, if the job was processed without a jam, these originals are then re-fed from the RDH tray and transported across the platen to the SADH output tray 78. These documents are thus also automaticaly ejected and restacked on the same document output stack in proper collated order face up.

The next job is then fed in and handled in the appropriate one of the above two manners, and so on, until the entire job stack at the input has been fed in.

An example of the operator programming slip or insert sheet 74 may look as follows:

| QUANTITY | 1 Staple | 2 Staple | Bind | Multiple Original | |
|---|---|---|---|---|---|
| 1111 | ☐ | ☐ | ☐ | Yes | No |

-continued

| | | | | | | | | | | | | |
|---|---|---|---|---|---|---|---|---|---|---|---|---|
| 2222 | | | | | | | | | | | | |
| 3333 | | | | | Reduction | | | | | | | |
| 4444 | | 100% | | 92% | | 86% | | 74% | | 64% | | Tabs |
| 5555 | | | | | | | | | | | | |
| 6666 | | | | | | | | | | | | Paper Tray |
| 7777 | Right | | | | <Image Shift> | | | | | Left | 1 | 2 3 |
| 8888 | | .2 | .4 | .6 | .8 | .2 | .4 | .6 | .8 | | | |
| 9999 | | | | | | | | | | | | Output Tray |
| 000 | | | | | | | | | | | | Top Stacker |
| | Lighter | | | Copy Contrast | | | | | | Darker | | |
| | | | | | | | | | | | | Covers |
| | | | | | | | | | | | | Yes No |
| | | | | | | [Etc.] | | | | | | |

The operator may program the sheet 74 via lead pencil markings which are then read by a reading scanner or sensor array 90. Note the exemplary above-cited art thereon. For faster and easier programming, there would be default conditions. For example, if no reduction is selected, 100% is assumed.

Referring to another example of a system for slip sheet programming, as noted above, such programming may provide special (different) programming of the copying of selected documents selected by a control system for a recirculating document handler actuated automatically by reading special document slip sheets fed with, but ahead of, regular documents. However, it may not always be necessary or desirable to require this programming to be done by reading information from the slip sheets. There are other known means for preprogramming. If the slip sheets are used only to indicate separate jobs, then a separate special sensor array such as 90 can be eliminated. The slip sheets may specially designed to interact with a pair of existing document jam sensors in the RDH to indicate separate jobs and actuate the special programming. These document slip sheets may be of ordinary paper, but notched at at least one location corresponding during feeding to at least one of the plural document jam or document width sensor locations spaced transversely of the document path of the RDH and/or SADH, to provide a special logic control signal from the actuation/non-actuation combination signal of said plural jam sensors which is different from a noraml jam signal. This control signal can actuate a preset special preprogrammed copying mode, of various kinds. This slip sheet control system does not require additional or special sensors, switches or other inputs. It uses existing machine hardware, with only slight added software.

The objective is to be able to load large and/or multiple jobs, separated only by such encoded slip sheets, start the copier and leave the copier and document handler unattended. This is accomplished with this system. Using a top VCF or other job stack input feeder as described herein permits advance stack loading and unattended copying of multiple jobs in excess of, e.g., 2500 original sheets.

In operation, jobs are loaded into the input or job feeder tray 70, at any time. This feeder may use much of the same hardware as a high capacity copy sheet feeder. It preferably has an elevator 76 to keep the top of the stack at the level of the feed head. All originals are preferably stacked in the tray 70 face down, in their conventional 1—N order. The operator places an encoded slip sheet on top of (leading) each separate job stack. Each job sheet 74 is fed like a document sheet but is read while it is being fed, preferably in the top feeder path to the SADH input 22, or in the SADH input. This slip sheet contains all the programming information needed to complete the job, but does not have to indicate the number of originals fed or the number of originals per job. That figure may be automatically derived by the controller by counting the number of documents inputted, and the number of documents inputted between succesive slip sheets, using the existing document sheet sensors and document counting software.

The first slip sheet, which is on the top of the stack, is sensed as a slip sheet (rather than a regular document). It is fed down the vertical transport to the SADH input, fed across the platen without imaging, and then fed directly into the document output stacking tray. Alternatively, slip sheets can be separately ejected. Somewhere along the path, either in the top feeder or as it enters the RDH, the slip sheet contents are read by the scanner 90 and this encoded information to complete that job is stored.

The job feeder 72 then sequentialy feeds the remaining originals in that job face down onto the platen, where they may be imaged as required. For an RDH job, they are then fed into the RDH feed tray. The top feeder continues to feed in this manner until the next slip sheet is reached, except for the special case of an RDH job which exceeds the capacity of the RDH. As sheets feed to the RDH tray, a natural inversion takes place in that path such that all originals are now face up in the RDH tray. This original set is now recirculated to produce the required and corresponding number of copy sets or books. The documents and copies can be either simplex or duplex since the RDH has its own inverter and all features of the current document handler are retained. On the last pass or circulation through the RDH, the originals are now fed out to the high capacity exit tray where they are stacked. After the last original of that recirculated set is sent to the exit tray, another job batch of originals is sent from the job feeder up to the RDH tray, if it is another RDH job, or sequentially fed straight through by the platen tranport if it is an SADH job. RDH and SADH jobs may be freely intermixed. Slip sheets need not be copied or circulated in any mode. This sequence is repeated until all jobs have been processed.

Note that this system is not as just another document handler per se. It is a complete document handling system containing very differently operating document stackers and feeders but all working in concert to load, sense, feed, register, copy, recirculate, invert, stack, and separate originals and sets of originals to produce properly collated copies.

This system has several important features:

1. Extraordinarily large jobs can be run, even in RDH mode. Consider a request for 100 precollated books of a 2000 page job. This job would be run in segments or sub-jobs. The job feeder would feed off only 250 originals at a time, if that is the capacity limit of the RDH tray. The system would RDH load and recirculate and copy those 250 originals 100 times, exit them, and then feed in and load and copy and eject another 250 originals. This would automatically continue four times, for the 2000 sheets in that job, because this RDH sub-job sequencing continues automatically until all RDH job documents from the job feeder stack have been transferred to the RDH and recirculated or until the next job's slip sheet is encountered.

2. It is possible to load additional originals into the high capacity job input stacker while the RDH is already copying and recirculating other originals. The operator can be signaled by a controller display when the system is not job inputting, and the input feeder is free, to lower the input stack elevator and allow the operator to add new originals or jobs. Added original sheets or jobs stacked on top of others are desirably run first, on a last in-first out basis, like a job interrupt, unless the operator lifts the existing job input stack and inserts the additional job(s) thereunder.

3. No copying productivity loss need be incurred since there are no RDH loading or unloading cycles in which copies can not be made and the job feeder provides unattended immediate RDH tray reloading.

4. The RDH retains its ability to run original sets loaded manually directly into the RDH feed tray, which is desirable if only one job is to be run.

5. A3 or 11"×17" size originals can be loaded in the high capacity job input tray, although preferably they would not be intermixed within the same job with A4 or 8½"×11" originals. Large documents may be automatically run in SADH mode, i.e., when detected by the existing document size sensors. The only potential modification to the job feeder for large documents would be to shift the feed head position, if needed.

6. A multifeed in the high capacity job feeder should have no effect on the set integrity of the job since slug or double sheet feeds, even if they make it all they way through the RDH without separating, will arrive in the RDH feed tray in the proper orientation.

7. Although not fully shown, a CFF path can still pass under or otherwise bypass the job feeder. Therefore this system retains the desirable features of the RDH/CFF of Ser. No. 029,027 filed Mar. 23, 1987 by the same Thomas Acquaviva.

Referring now further to the exemplary copier 10 of FIG. 1 here, the copier 10 is conventionally adapted to provide either duplex or simplex precollated copy sets from either duplex or simplex original documents presented by the RDH 20, on various type of copy sheets. Two separate copy sheet trays 47 and **47*a* are provided, for feeding clean copy sheets from either one selectably, plus a high capacity paper feeder "H" shown at the lower right hand side here. This high capacity feeder H may be similar to the document job feeder 72**.

The copy sheets are fed from the selected one of the paper trays 47 or **47*a* via a paper path 64 to the transfer station 48, for the conventional transfer of the xerographic toner image of document images from the photoreceptor 12 to the first side of a copy sheet. The copy sheets are then fed by a vacuum transport to a roll fuser 49 for the fusing of that toner image thereon. From the fuser 49, the copy sheets are fed through a sheet decurler 50. The copy sheets then turn a 90° corner path 54 in the copy sheet path which inverts the copy sheets into a last-printed face-up orientation before reaching a pivotal decision gate 56. The image side which has just been transferred and fused is face-up at this point. If this gate 56 is down it passes the sheets directly on without inversion into the output path 57 of the copier to the finishing module "F". If gate 56 is up it deflects the sheets into a duplex inverting transport 58. The inverting transport (roller) 58 inverts and then stacks copy sheets to be duplexed in a duplex buffer tray 60**.

The duplex tray 60 provides intermediate or buffer storage for those copy sheets which have been printed on one side and on which it is desired to subsequently print an image or images on the opposite side thereof, i.e. copy sheets in the process of being duplexed. Due to the sheet inverting by the roller 58, these buffer set copy sheets are stacked into the duplex tray 60 face-down. They are stacked in this duplex tray 60 on top of one another in the order in which they were copied.

For the completion of duplex copying, the previously simplexed copy sheets in the tray 60 are fed seriatim by its bottom feeder 62 back to the transfer station 48 for the imaging of their second or opposite side page image. This is through basically the same copy sheet transport path (paper path) 64 as is provided for the clean (blank) sheets from the paper trays. It may be seen that this copy sheet feed path 64 between the duplex tray 60 and the transfer station 48 has an inherent inversion which inverts the copy sheets once. However, due to the inverting transport 58 having previously stacked these buffer sheets printed face-down in the duplex tray 60, they are represented to the photoreceptor 12 at the transfer station 48 in the proper orientation, i.e. with their blank or opposite sides facing the photoreceptor 12 to receive the second side image. This is referred to as the "second pass" for the buffer set copies being duplexed. The now fully duplexed copy sheets are then fed out again through the fuser 49 and fed out into the output path 57.

The output path 57 here transports the printed copy sheets directly, one at a time, into the connecting, on-line, modular, finishing station module "F", shown in detail in FIG. 2. There the completed precollated copy sets may be finished by stapling, stitching, gluing, binding, and/or offset stacking. Suitable details are disclosed in the cited art, or other art, or in the applications cross-referenced hereinabove, and are further described hereinbelow with reference to FIG. 2.

Some additional examples of prior automatic on-line collating copier finishers (staplers, stitchers, gluers or other binders) and/or offsetters and their controls, are disclosed in U.S. Pat. Nos. 3,630,607 issued Dec. 28, 1971 to H. Korn et al.; 3,793,016 issued Feb. 19, 1974 to R. N. Eichorn; 4,134,672 issued Jan. 16, 1979 to L. B. Burlew et al.; 4,328,919 issued May 11, 1982 to B. R. Lawrence et al.; 4,344,544 issued Aug. 17, 1982 to T. Cross; 4,398,986 issued Aug. 16, 1983 to Robert C. Smith et al; 4,516,714, issued May 14, 1985 to Oskar J. Brahm; U.S. Pat. No. 4,328,919 issued May 11, 1982; and "Research Disclosure Journal" publications Nos. 22733 and 22734 on pages 120–134 of the March 1983 issue (anonymous). Another copier on-line glue binder is disclosed in the Xerox Disclosure Journal Vol. 4, No. 4, p. 425, July 1979. These may be alternatively used with the disclosed system by, e.g., changing the activation times and activation rates as described herein for their compiler or accumulator binding operations. Other on-line stapling systems for multi-bin collation include Xerox Corp. U.S. Pat. No. 3,884,408 issued May 20, 1975 to L. L. Lieter, et al; and U.S. Pat. No. 4,087,087 issued May 2, 1978 to John H. Looney.

Copy sets can be forwarded out of the disclosed finisher on to additional finishing stations if desired. For example, to a hole puncher, ring binder, GBC binder, or the like.

Referring now to FIG. 2, the general operation of exemplary finishing station module "F" here will now be described. Certain sheet path similarities will be noted with the previously described operations of U.S. Pat. No. 4,385,827 by R. Naramore. Finishing station F receives fused copies from the copier (FIG. 1), compiles and finishes copy sets, and delivers them to the output sheet stacking apparatus, indicated generally by the reference numeral 102. Alternatively, it delivers copies to the top output tray 101. Sets of copy sheets delivered to output sheet stacking apparatus 102 are normally collated, but may be uncollated, and may be finished or unfinished. Unfinished sets may be offset. Finished sets may be stitched with one or two stitches. Finishing station F can also glue-bind sets and deliver stacks of bound sets to stacking apparatus 102.

The sheet path of finishing station F includes an inverter 104 driven by a reversible motor. The inverter has a solenoid actuated diverter gate that diverts sheets into the inverter, and a tri-roll nip that is used to drive sheets into and out of the inverter. It also has a compression spring which assists in reversing the direction of the sheets and assists in driving them out of the inverter.

Registration transport 106 is used to transport sheets from inverter 104 to output transport 108. Two cross roll registration nips are used to side register the sheets. The cross roll registration nips are driven by the sheet path drive motor. The output transport 108 is also driven by the sheet path drive motor. It transports sheets from the registration transport to a top tray gate where the sheets are diverted to either vacuum transport 110 or out into top tray 101.

Vacuum transport 110 is used to transport sheets from transport 108 to any selected one of three bins 112, 114 or 116. Bins 112, 114 and 116 are all used to compile and register sheets into completed copy sets. A separate gate (set of stripping fingers) is associated with each bin, as illustrated, to selectively deflect each sheet on the transport 110 into a selected bin 112, 114 or 116. A known in-bin scuffer wheel system may be provided as illustrated to maintain stacking registration. The set of compiler bins 112, 114, 116 are driven up and down as a "bindexer" unit (note the illustrated dashed-line positions) by a bi-directional bin drive motor adapted to position the proper bin at the bin unloading position. There a set unloading transport 118 may have, for example, a pair of set clamps mounted on two air cylinders and driven by four air valve solenoids. Two of the air valves are used for positioning the set transport and two are used for the retract function. The set transport 118 is used to transport sets from the bins to the stitcher 120, or binder 122, and to the sheet stacking apparatus 102. The stitched, bound, or unfinished sets are delivered to the stacking apparatus 102 where they are stacked for delivery to the operator.

Each bin preferrably has a registration gate or pair of vertical stops at the unload side thereof which is automatically pivoted out of the way after the set clamp of the unloading transport 118 has grasped that set, so as to allow the set removal from the bin by horizontal movement of the unloading transport 118.

Exemplary details of the other suitable copy set transports and finishing apparatus are described in references cited herein and elsewhere, including various means for reaching into a bin to grasp and remove a completed, compiled, collated, copy set therein.

Note that bin unloading desirably occurs at only one vertical position or level of the bins, to simplify set retrieval and finishing. Thus the bin set indexes up and down so as to place the bin containing the next completed set to be removed adjacent this unloading position, alligned with set unloading transport 118. But bin loading here can be done into any bin, i.e. in any position of the bins, and simultaneously with bin unloading. However, the controller inhibits loading of a bin in the process of being unloaded, or a bin already containing a completed copy set. Sheets can enter bins either above or below the set ejecting level, and on either the up or down movements of the bins, even through the bin entrance velocities of the sheets will vary depending on the bin movement relative to transportation.

To summarize, all three compiler bins index up and down as a unit for unloading of compiled sets from a single vertically fixed position adjacent the downstreams sides of the bins. Incoming sheets are on the vertical sheet transport 110 moving by the upstream or copier sides of all the bins and their respective independent input gates. There is no vertically fixed sheet entrance position and any bin can be loaded in any position of the bins. Individual sheets can enter a bin above or below the compiled set eject level (the unloading position), and during both up and down cycles of the bins, and from the opposite side. Thus, the disclosed finisher "F" has a "through the bins" architecture, and a small number of bins architecture, so that the load and unload functions do not interfere with one another or prevent bi-directional movement of the bins relative to the set removal means. A dual flash operating system can provide full productivity, without any copier pitch skips, for multiple simplex finished copy sets of three or more page documents sets. It was discovered that three compiler bins was the minimum number required to support full system productivity with dual flashed 3 pitch sets. While the first one pair of copy sets is being finished, the other set of that pair of copy sets can remain waiting to be finished in a bin, yet meanwhile the next pair of copy sets can be made and loaded into the two bins which are now empty. Then the second completed set can be removed and finished while the next pair of copy sets is being completed. Then one of the next pair of copy sets can be removed and finished while a third pair is started, and so on.

The sequences of feeding into and compiling copy sheets in said compiler bins and removing compiled collated copy sheet sets from said compiler bins of said compiler system desirably comprises sequences substantially as follows; where "A", "B" and "C" are designations for the respective first, second and third compiler bins, where "N" is the designation of the first copy sheet to be fed into a compiler bin of a total of N copy sheets in a collated copy sheet set to be compiled therein, where "1" is the last fed copy sheet of that copy set, where " - - - " represents the repetition and continuation of the associated sequence "N" to "1" between said first and last copy sheets of that sequence for that copy set, and where "{EJECT->}" represents the removing of that completed compiled collated copy set from that respective compiler bin by said removal means:

```
C
B            __N__   __N-1__              ---
A   __N__                  __N-1__       ---

C
B   ---        __2__   __1__ {EJECT->}
A   --- __2__                  __1__ {EJECT->}

C        __N__         ---     __1__ {EJECT->}
B   __N__    ---       __1__ {EJECT->}
A
```

In this above description the bins are referred to as A, B and C, rather than 112, 114, and 116, in order to emphasize that the sequence is not limited to that physical order. Each bin has its own integral gate, solinoid operable in any order programmed by the controller. Since the gates move with their bins but maintain interdigitation with the transport 110 belts, sheets can be loaded into bins in any bin position, and while the bins are moving.

Note that a typical bin LOADING order or sequence is A,B;B,A;A,B;B . . . etc., to completion of 2 sets, then C,B;B,C;C,B . . . etc. for the next two sets, as shown above, etc.. A typical repeating bin UNLOADING or eject order is B,A;B,C . . . etc., as shown above, or it could be A,B;C,B;A,B;C,B . . . etc. The first sheet of the next set enters a bin on the second pitch of an eject cycle.

The bin entry order is altered if required for the last pages so that the last pages of the 2 sets land in B then A if the unload order is to be B,A. They land in B then C if the unload order is to be B then C. Example: load the last 3 pairs of sheets in the order . . . A,B;B,A;B,A for an odd number of pages so that bin B will be ready to unload first. Thus, the first bin load order with the first two sheets is not important, but can be chosen for consistency. This key to productivity is that the first bin scheduled to be unloaded is loaded with the first one of the last two sheets of the two set being completed. This enables an unload to start one pitch sooner.

Important features of the disclosed system include those whereby the desired dual flash is combined with a 3 (or 4) bin finisher to allow the finisher to support a high speed, high volume, copier, e.g., a more than 100 cpm system, at full productivity for even 3 sheet sets, while operating the staplers or stitchers are the same cyclic rate as a much slower system, such as for a precollation copier of hald that speed. With the system here the RDH need only handle and recirculate documents at a document per minute repeat rate which is only one half the full copier rate in order to support the system. This has the very desirable provision of correspondingly increased available document acquisition and exchange times. Copy sets or books are compiled (accumulated, stacked or "staged") into the 3 bins, entering from one side of the bins and exiting another side (here the opposite sides in the processor paper movement direction). The finishing repeat rate may be reduced to once every 3 pitches for 3 sheet sets, or 4 pitches for 4 or more sheets.

A key feature of this system which enables this productivity is the sequential use of different pairs of the three compiler bins in coordination with finishing so that while the second of one pair of copy sheet sets is being removed from a bin and finished, the first two sheets of the next sequence or set are entering two other now empty and available bins, in a continuous enter one side/exit the other side sequential operation.

Another disclosed feature is the use of the copier duplex tray to accumulate and stage multiple dual side one's (pairs of half finished duplex copy pair buffer sets) in the duplex tray. This system utilizes a modification of the system for plural single flash buffer sets disclosed in U.S. Pat. No. 4,278,344 to R. B. Sahay and other such references, supra. With the plural pairs buffer set system here (a) some inversions of duplex originals are avoided; and (b) small duplex document sets which otherwise could not repeat or recirculate through the RDH at the full rate of the copier without skipped pitches are flashed at the full rate. In this multiple dual side one's system, the documents are recirculated around the RDH loop path as if simplex copies were being made (i.e., without inversion) until a desired number of sets of sides 1's are accumulated in the duplex tray appropriate to its desired (e.g. 100 sheets) or maximum total sheet capacity. E.g., copy sheets with odd document pages on one side are accumulated in the duplex buffer tray in the sequence N, N; N−2, N−2; . . . 3,3;1,1 repeated several times up to a maximum number of such buffer sheets desired, or a corresponding even page sequence, depending on the desired output inversion. The number of such plural buffer sets made consecutively will vary with the number of documents in the document set, since that determines the size of each buffer set.

For a 3 flash closeout, the duplex buffer tray may be loaded with buffer sets of N,N,N;N−2,N−2,N−2; . . . 3,3,3;1,1,1, providing the total number of buffer copies made this way does not exceed the maximum number desired there, in which case single flash closeout is made automatically.

The duplex documents are then inverted so that in subsequent circulations their side 2's are then copied, by repeating dual flashes, onto the backsides of the buffer sets from the duplex tray. But this way the RDH has only done one inversion of originals. Thus the RDH only has to perform one inversion cycle to copy up to, e.g., 100 sheets into the duplex tray, even for small document set sizes. Side 1 sets in the duplex tray are fed out and imaged on their other sides with dual side 2 image sets repeatedly until the duplex tray is emptied, and then the process can repeat, by a number of times depending on the number of copies required for the job. However, when sets of greater than about 50 sheets are encountered the staging of multiple sets in the duplex tray is no longer applicable.

This above plural paired buffer system allows duplex to duplex operation with multiple copies of even document sets as small as 3 sheets at the full rate of the copier despite an RDH inversion cycle rate for recirculation with inversion of such small document sets which would otherwise limit the output rate of 6/7ths of the full rate if dual copy sets were merely flashed in pairs with side 1's immediately following side 2's, i.e. with the duplex documents being inverted in each circulation.

Another disclosed feature is that dual flash is replaced by triple flash on closeout of a job with an odd copy count. This added but compatible system avoids an extra single flash sequence which would have to be performed at half rate. This special case algorithm is actuated automatically by operator selection of an odd number of copies only for the final copying circulation of the set of originals. It avoids one entire RDH circulation in the case of an odd number of copies, and avoids the RDH rate of less than the copier rate from limiting productivity to the RDH rate, which it would if a single flash closeout was required for odd numbers of copy sets.

Another feature relates to the loading and feeding of inserts or special copy sheets, such as tabbed sheets,, transparencies, chapter separators, covers, etc. To utilize the normal dual flash operation here these special copy sheets are normally loaded in pairs into a paper feed tray different from the paper feed tray being used for regular copy sheets, and programmed to be alternatively fed to be copied to be in the appropriate positions in the copy sets. If thse special sheet inserts differ from one another they are preferably loaded into their selected paper tray 46 or 47 in collated order. The controller "C" 100 knows from its operators input when such special inserts are being used and can inhibit what would otherwise be run as a triple flash closeout, which would not feed the paired special sheets properly. If an odd number of copies has been selected, a single flash closeout can be used by purging one of the two special sheets into the tray 100 for example, rather than inserting it into a compiler bin.

Automatic post-collation can be alternatively provided with the same configuration for up to the number of available bins (3 or 4), i.e., if no more than 3–4 copies were keyed in by the operator to be made. In that case, the copier can make 3 or 4 consecutive copies of each document and the bins can be used to collate that output. This is an ADF/sorter or post-collation mode of operation.

For each job, there is one sequence which optimizes productivity and minimizes the number of RDH or copy handling module (CHM) pauses and inversions. The machine logic selects the optimum operating sequence based on the modes selected, the number of originals, and the number of copy sets. The system will function in the simplex/simplex, simplex/duplex, duplex/duplex and duplex/simplex modes, respectively.

To summarize, there is disclosed an RDH/finishing system and algorithms for paper flow in copiers providing unlimited collated output with an RDH. It enables normally making two copies at a time at the maximum copying speed of a high speed copier from each original circulating in the RDH at a maximum original recirculation rate of one half that copying speed, thus maintaining full productivity of both the copier and the RDH. The copies are variably shunted into the bins of a 3-bin compiler of a finisher in such a way that one bin or another is available for copy set removal and finishing without interfering with continued copy sheet loading into the other two bins. The algorithms are extended to efficiently handle duplex and odd-number copy counts. Features include dual flash, or copy pairs, loading of alternate 2 of 3 (or 4) bins, and a special finishing cycle with triple-flash close-out for odd numbers of copy sets (but single-flash close-out for large duplex odd numbered sets for which the capacity of the duplex buffer tray could be exceeded by a triple-flash buffer sets).

It is important to note that in the system disclosed herein, that the three trays or bins of the finisher unit are not normally functioning as sorter or collator or stacker bins. The copy sheets normally already leave the copier and enter the finisher unit precollated, in a page sequential order, albeit normally in interleaved adjacent pairs thereof, due to the RDH copying. Rather, two of said bins function to separately stack two precollated pairs at a time as they so emerge from the copier during the same time period as the other, third, bin serves as a waiting station holding a previously stacked completed copy set which is awaiting removal and finishing, and meanwhile another previously stacked and removed set is being finished in a single finisher. Normally all of this occurs continuously and repeated without any delay or pause in copying at the full copying rate of the copier.

While the embodiment disclosed herein is preferred, it will be appreciated from this teaching that various alternatives, modifications, variations or improvements therein may be made by those skilled in the art, which are intended to be encompassed by the following claims:

What is claimed is:

1. A document job handling system for a precollation copier with a recirculating document handler for recirculating and repeatedly sequentially presenting documents to the platen of said copier for copying, wherein said recirculating document handler has a document stacking tray adapted to receive for said recirculative precollation copying a set of documents loaded therein of up to a preset capacity number, and wherein said recirculating document handler also has a separate, alternate, document entrance for receiving documents and feeding them to said platen for non-recirculative, non-precollation, copying, and document ejection means for ejecting documents from said recirculating document handler which have been fed to said platen from said alternate document entrance, and document gate means for selectably feeding documents to said document ejection means or to said document stacking tray, and control means for controlling the operation of said recirculating document handler; said document job handling system comprising:

document job batch loading means operably connecting with said alternate document entrance, said document job batch loading means comprising stacking means for stacking a plurality of document set jobs, and document job feeding means for sequentially feeding documents individually from a stack thereof in said stacking means to said alternate document entrance;

job mode selection means communicating with said control means to provide information for said control means for documents being fed by said document job feeding means to said alternate document entrance to determine to whether to operate said recirculating document handler to copy those documents in a recirculative precollation copying mode or a non-recirculative, non-precollation, copying mode;

said control means, when said documents being fed by said document job feeding means to said alaternate document entrance are so determined to be copied in a recirculative precollation copying mode, operating said recirculating document handler and said document gate means thereof to automatically sequentially load said documents being fed by said document job feeding means to said alternate document entrance into said document stacking tray, up to said preset capacity number, and then to automatically recirculate and repeatedly sequentially present said documents to said platen of said copier for copying, and then to automatically eject said documents from said recirculating document handler with said document ejection means.

2. The document job handling system of claim 1 wherein said job mode selection means includes job separation means communicating with said control means to indicate the feeding of separate document jobs by said job batch loading means.

3. The document job handling system of claim 2 wherein if the number of said said documents being fed by said document job feeding means to said alternate document entrance for a single precollation copying job exceeds said preset capacity number of said document stacking tray before said job separation means communicates with said control means to indicate the feeding of a separate copying job, said single precollation copying job is automatically divided into separately recirculated sub-job sets of documents of a number not exceeding said preset capacity number of said document stacking tray, and said documents being fed by said document fed feeding means to said alternate document entrance are automatically interrupted during said recirculations of said separately recirculated sub-job sets of documents.

4. The document job handling system of claim 2 wherein said job separation means comprises slip sheets interleaved between separate document jobs and and fed with said document sheets from said document job batch loading means, and slip sheet detecting means for detecting said feeding of said slip sheets.

5. The document job handling system of claim 4 wherein said mode selection means includes selectable variable job information indicia on said slip sheets, and slip sheet information indicia reading means for reading said selectable job information indicia on said slip sheets for controlling said control means to variably copy documents fed after a said slip sheet is so read in accordance with said selectable variable job information indicia thereon.

6. The document job handling system of claim 1 wherein said stacking means for stacking a plurality of documents and document set jobs in said document job batch loading means is adapted to commonly stack all said documents job sets face down in a common stack thereof, and said document job feeding means comprises a top feeder for sequentially feeding the topmost document sheet in said common stack in said stacking means directly to said alternate document entrance of said recirculating document handler without inversion; and wherein said job handling system further includes job output inverting and stacking means for commonly stacking all said document set jobs face up in a common stack thereof after said automatic ejection of said documents from said recirculating document handler with said document ejection means.

7. In a copying method for sequentially recirculatively presenting document sheets to the platen of a copier for precollation copying with a recirculating document handler, wherein said recirculating document handler has a document stacking tray into which a set of document sheets is loaded for said recirculative precollation copying, up to a preset document sheet capacity number, and wherein said recirculating document handler also has a separate, alternate, document entrance for receiving document sheets and feeding them to said platen, and document ejection means for ejecting document sheets from said recirculating document handler after their copying, and document gate means for selectably feeding document sheets to said document ejection means or to said document stacking tray, and control means for controlling the operation of said recirculating document handler; an automatic document job batching system comprising the steps of:

stacking document sheets to be copied as a batched plurality of document set jobs in a job loading input adjacent said recirculating document handler;

sequentially feeding said document sheets individually from said job loading input to said alternate document entrance;

selecting whether to operate said recirculating document handler to copy said document sheets fed from said job loading input in a recirculative precollation copying mode or in a non-recirculative, non-precollation, copying mode;

when said document sheets being fed from said job loading input are selected to be copied in a recirculative precollation copying mode, operating said recirculating document handler and said document gate means thereof to automatically sequentially load a document set job of said document sheets into said document stacking tray, up to said preset document sheet capacity number, and then automatically recirculatively copying those document sheets, and then automatically ejecting those document sheets from said recirculating document handler with said document ejection means;

when said document sheets being fed from said job loading input are selected to be copied in a non-recirculative non-precollation copying mode, operating said recirculating document handler and said document gate means thereof to automatically sequentially copy and then eject those document sheets from said recirculating document handler with said document ejection means without recirculation and without loading those document sheets into said document stacking tray;

and then automatically feeding further document sheets from said job loading input into said alternate document entrance for copying in a selected said recirculative precollation copying mode or non-recirculative non-precollation copying mode.

8. The automatic document job batching system of claim 7 wherein if the number of said said documents being fed from said job loading input to said alternate document entrance in a single document set job exceeds said preset document sheet capacity number of said document stacking tray, said document set job is automatically divided and separately loaded in said document stacking tray, and separately recirculated, as sub-job sets of document sheets of a number not exceeding said preset number, and the document-sheets being fed from said job loading input to said alternate document entrance are interrupted during said recirculations of said separately recirculated sub-job sets of document sheets.

9. The automatic document job batching system of claim 7 wherein slip sheets are interleaved between separate document set jobs in said job loading input and fed with said document sheets fed from said job loading input to automatically indicate separate document set jobs and maintain job separations.

10. The automatic document job batching system of claim 9 wherein said slip sheets contain selectable variable job information indicia which is read to control variable copying of document sheets fed after a said slip sheet is so fed and read.

11. The automatic document job batching system of claim 7 wherein said plurality of document set jobs are commonly stacked face down in a common stack in said job loading input and the document sheets thereof are fed sequentially from the top of said common stack to said alternate document entrance of said recirculating document handler without inversion.

12. The automatic document job batching system of claim 7 wherein said document set jobs are stacked face down in said job loading input and the document sheets thereof are top-fed sequentially to said alternate document entrance of said recirculating document handler without inversion; and wherein after said copying thereof they are ejected with said document ejection means and inverted and restacked face up.

13. The automatic document job batching system of claim 7 wherein said stacking of a plurality of document set jobs comprises intermixing and commonly stacking individual document jobs and separate plural document jobs and interleaving slip sheets.

* * * * *